United States Patent [19]

Kiltie et al.

[11] Patent Number: 4,684,912

[45] Date of Patent: Aug. 4, 1987

[54] WINDING FORM FOR HIGH VOLTAGE TRANSFORMER

[75] Inventors: Ordean Kiltie, Fort Wayne; Thomas C. Marrs, N. Manchester, both of Ind.

[73] Assignee: Marshall Electric Corporation, Rochester, Ind.

[21] Appl. No.: 883,692

[22] Filed: Jul. 9, 1986

[51] Int. Cl.[4] ..... H01F 27/30

[52] U.S. Cl. ..... 336/185; 336/198; 336/225; 336/231

[58] Field of Search ..... 123/621, 634; 336/185, 336/198, 208, 221, 180, 225, 231

[56] References Cited

U.S. PATENT DOCUMENTS

| | | | |
|---|---|---|---|
| 2,351,604 | 6/1944 | Ferrill, Jr. | 336/231 X |
| 3,573,694 | 4/1971 | Von Fange et al. | 336/231 X |
| 4,580,122 | 4/1986 | Wörz | 336/225 X |

*Primary Examiner*—Thomas J. Kozma

*Attorney, Agent, or Firm*—Pearne, Gordon, McCoy & Granger

[57] ABSTRACT

An automotive ignition system transformer including a ferromagnetic core, a primary coil and a secondary coil. The secondary windings are wrapped on a tubular insulating winding form or bobbin with annular radial portions defining a plurality of annular coil chambers including a plurality of central chambers and at least one end chamber. The end chamber defines a spiral land that proceeds both axially toward the respective end and radially outward for three or more complete turns. The respective end turns of the coil are wrapped one turn of coil on each turn of the spiral land so that successive turns of the end portions of the secondary coil are both axially and radially spaced from one another sufficiently to minimize arcing.

5 Claims, 4 Drawing Figures

WINDING FORM FOR HIGH VOLTAGE TRANSFORMER

BACKGROUND OF THE INVENTION

This invention relates to high voltage transformers and especially to those used in ignition systems for internal combustion engines. More particularly, the invention relates to a tubular winding form or bobbin for the secondary windings of an ignition transformer wherein the primary windings and ferromagnetic core are located within the winding form.

High voltage transformers for ignition systems in modern internal combustion engines generally include a tubular winding form that receives a ferromagnetic core (generally of laminated construction), primary windings surrounding the core and secondary windings wrapped around the winding form. The transformer is generally capable of producing a secondary voltage of around 30 Kv or more.

The form usually has a plurality of axially spaced annular partitions that define annular chambers therebetween. The turns of the secondary windings are wound in the first chamber at one end until the chamber is filled to a desired level. Then the windings proceed to the next chamber such as by passing the wire through a helical transition slot formed in the respective partition and then filling the next adjacent chamber to the same level. This process is continued until all the chambers are filled progressively from one end to the other. The actual winding of the secondary coil is usually accomplished with automatic coil winding equipment.

In modern ignition systems, wider spark gaps are being used (e.g. such as in the range of 0.05 inches and higher) in order to achieve better fuel economy. As a result, higher sparking voltages are necessary such as voltages in excess of 30 Kv. The ignition coils are thus subject to much greater voltage stress than in the past.

In order to accommodate this, several coils are often used in the system such as one coil for every two spark plugs. In this configuration, one end of the secondary coil is connected to one plug and the opposite end is connected to the other plug which is set to fire at an opposite portion of the engine cycle.

One problem that can occur during operation of modern automotive ignition systems of this type is arcing across adjacent coil turns during collapse of the transformer field at the firing point. The firing or arcing across the spark gap of the plug generates an RF voltage that may be reflected back through the ignition cable to the secondary coil. This high voltage transient or spike may have a frequency of around 10 MHz. The resulting RF energy is quickly dissipated in the first three or four turns of the secondary coil, however, the high RF voltage does present a danger of arcing in there first few turns. In fact, arcing from one end turn to the next frequently does occur, thus resulting in deteriation of the insulation on the conductor and of the dielectric material in which the conductor is embedded.

Testing has been accomplished on these coil ignition systems in nitrogen atmosphere pressure vessels under conditions that simulate actual engine operation and with the voltage level adjusted to provide optimum sparking. The tests verify that the RF voltage spikes generated causes deteriation of the insulation of the first few turns of the coil and thus premature coil failure.

The frequency and magnitude of the reflected RF signal is a function of the sparking voltage and the size of the spark gap.

It has been suggested that a solution to the problem is to enlarge the secondary coil form or bobbin to provide greater spacing between the end turns. The spacing would be sufficient to eliminate arcing. While this may be an effective solution, the enlargement of the coil form is often not possible because of the criticality of space for the various components in the engine compartment of the vehicle and in particular, the ignition system components.

The coil form or bobbin of the present invention reduces the difficulties indicated above and affords other features and advantages heretofore not obtainable.

SUMMARY OF THE INVENTION

It is among the objects of the present invention to reduce and/or eliminate arcing in the end turns of the secondary windings of an automobile ignition transformer.

Another object is to minimize the possibility of such arcing without changing the dimensional parameters of the secondary windings of the transformer or of the coil form or winding tube.

These and other objects and advantages are achieved with the unique secondary coil winding form of the invention which comprises a tubular member of dielectric material having annular partitions defining a plurality of annular coil chambers including central chambers and two end chambers. Each of the end chambers defines a spiral land that continues for several turns. The secondary coil is wrapped on the form and includes coil sections in each of the coil chambers. The coil turns of each of the end chambers are positioned in a spiral configuration in the spiral lands and have an inner end with a radius approximately that of the central chambers and which increases progressively toward the outer end. Accordingly, successive turns of the end portions of the secondary coil located in the end chambers are both axially and radially spaced from one another sufficiently to prevent arcing.

DESCRIPTION OF THE PREFERRED EMBODIMENT

Figure 1:
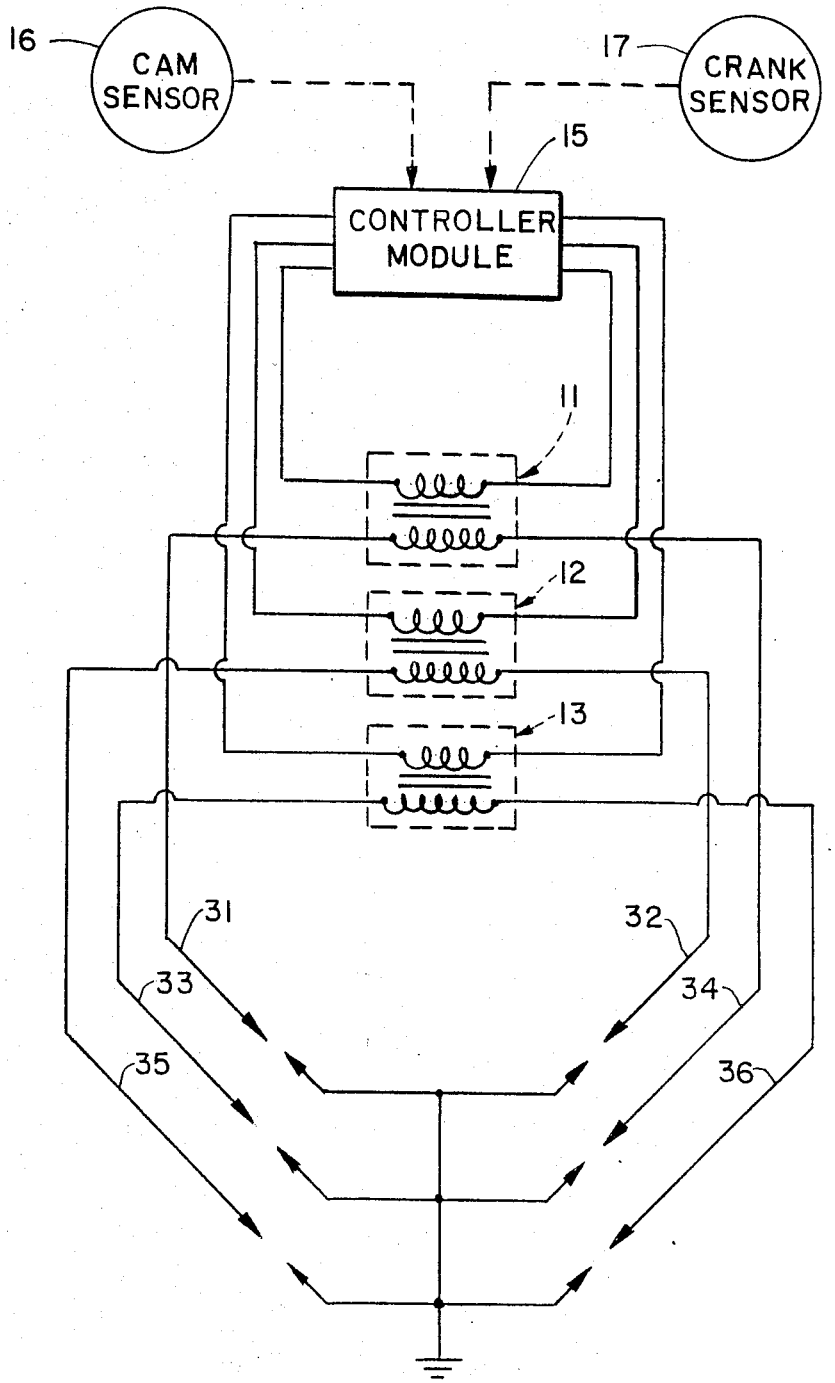
FIG. 1 is a schematic diagram illustrating a typical ignition system for a modern internal combustion engine with a V-6 type engine and utilizing three ignition transformers, one for every two cylinders.
Figure 2:
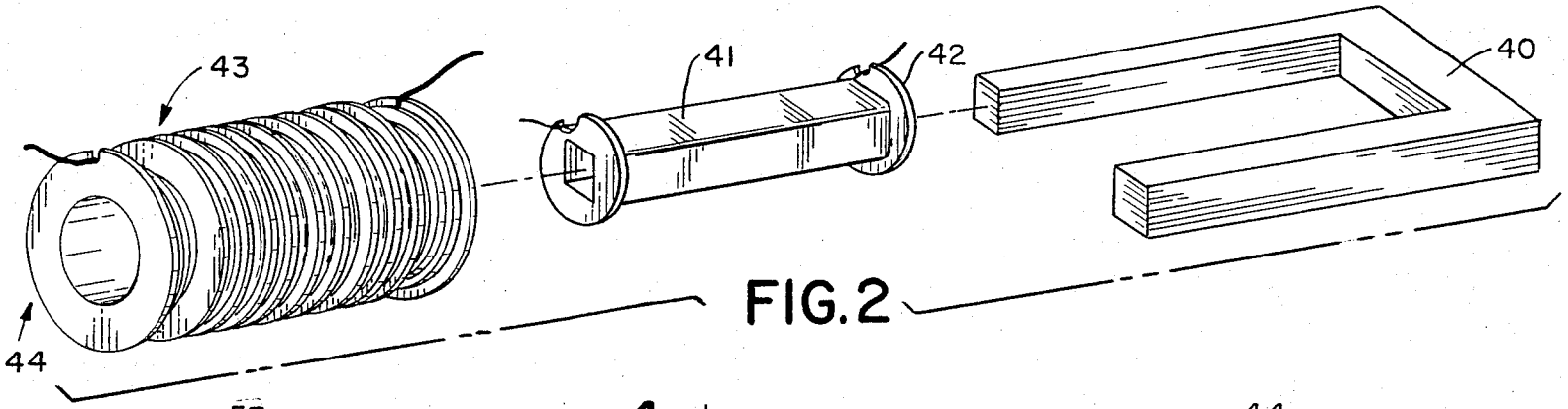
FIG. 2 is an exploded perspective view illustrating one of the three ignition transformers shown in FIG. 1 and embodying the present invention.
Figure 4:
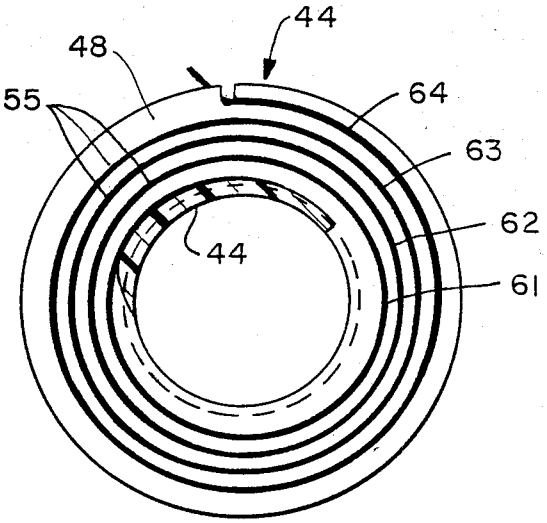
FIG. 4 is a transverse sectional view taken on the line 4—4 of FIG. 3.
Figure 3:
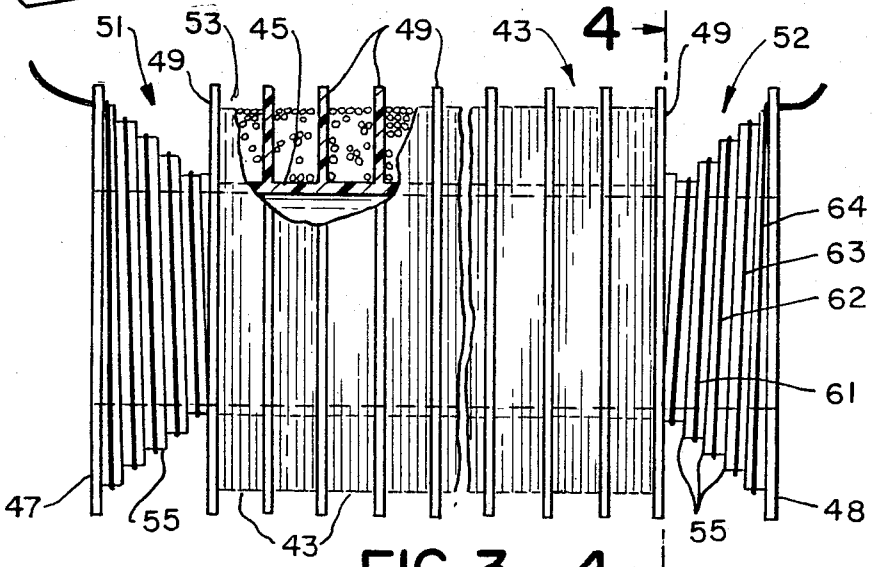
FIG. 3 is a side elevational view illustrating the ignition transformer of FIG. 2 in assembled condition and with parts broken away and shown in section for the purpose of illustration.

Referring more particularly to the drawings and initially to FIG. 1, there is shown an electronic ignition system typical of those used in modern automotive vehicle engines. The system illustrated is designed for a typical six cylinder engine where the crank shaft cranks lie in a planar configuration. The system utilizes three separate ignition transformers 11, 12 and 13, one for each of two cylinders that fire at opposite portions of the engine cycle.

The system includes a cam sensor 16 and a crank sensor 17 that input to a control module 15, which connects to the primary windings of the transformers 11, 12 and 13. The primary windings are energized to time the firing of the plugs that are fired by the respective secondary windings. The windings are energized in opposite modes depending upon the particular spark plug to be fired.

The plugs for the cylinder pairs are fired sequentially by the secondary coil of the transformer 11.

The invention will be illustrated with respect to the ignition transformer 11 which is identical to the transformers 12 and 13. While a floating transformer is illustrated and described herein, it will be understood that the invention is equally applicable to single ended transformers. The transformer 11 comprises a laminated, U-shaped, ferromagnetic core 40 of standard construction, a primary coil 41 wrapped on a winding tube 42 that surrounds one portion of the core 40, a secondary coil 43 wrapped on a winding form or bobbin 44 that surrounds and is concentric with the primary coil 41 and primary winding tube 42.

The invention is embodied primarily in the shape of the dielectric winding tube or bobbin 44 which is of generally tubular cylindrical form with an outer cylindrical surface 45, annular radially extending end partitions 47 and 48 located at opposite ends and a plurality of annular radial inner partitions 49. The end partition 47 defines with the next adjacent inner partition 49, an end chamber 51 and the end partition 42 defines with the next adjacent inner partition 49 and opposite end chamber 52.

The inner partitions 49 define a plurality of inner winding chambers 53, each of which receives a plurality of coil turns. The wire is wrapped from one end to the other generally using coil winding machines that are well known in the art. The coil is passed from one partition to the other through transition slots (not shown) that extend in a somewhat diagonal direction through the respective partition 49.

In accordance with the invention, the end chambers 51 and 52 are adapted to receive three or more turns of wire forming the secondary coil at the opposite ends of the winding tube 44.

As indicated heretofore, the primary purpose of the invention is to prevent arcing between the end turns as a result of the reflected RF voltage spike is generated at the time of firing and that is reflected back through the respective ignition lead to the secondary windings of the respective transformer.

This is accomplished by forming in each of the respective end chamber 51, 52 a spiral land 55 that progresses both axially and radially outwardly from an initial diameter approximately equal to the outer diameter of the winding tube 44 to a diameter slightly less than the diameter of the radial end partition 47 and 48.

The configuration of the spiral lands 55 is preferably selected so that the spacing is greatest between the first and second turns and then diminishes slightly from that point down to the smallest end turn.

The end turns include first, second, third and fourth turns, 61, 62, 63 and 64 respectively. However, more or less may be utilized as required.

In order to achieve optimum advantage of the increased turn spacing providing by the spiral land configuration, the rate of increase in the radius of progressive turns varies from the smallest to the largest turn. For example, where the spiral land has four turns, the spacing between the largest and next largest turn may be so designed as to be twice as great as the spacing between the smallest turn and its next adjacent turn. This is because the voltage drop from one coil to the next (and thus the potential for arcing) is greatest in the first end turn of the coil and then diminishes progressively for the first three or four turns.

The desired relationship between the radii of adjacent turns of the spiral land 55 will depend upon many factors such as space avalable, size of the winding form, design parameters of the particular ignition system, etc. all of which will be within the understanding and skill of those skilled in the art.

While the invention has been shown and described with respect to a particular embodiment thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. In an ignition system high voltage transformer having a ferromagnetic core and a primary coil surrounding a portion of the core and wrapped in helical fashion along a longitudinal axis, the improvement which comprises:

a tubular insulating winding form;

having partitions defining a plurality of annular coil chambers including central chambers and at least one end chamber;

said end chamber defining a spiral land;

a secondary coil wrapped on said form and including coil sections in each of said coil chambers;

the coil turns of said end chamber being positioned in a spiral configuration in the respective spiral land and having an inner end with a radius approximately that of the central chamber and increasing progressively in radius to the outer end thereof;

whereby successive turns of said end portion of said secondary coil located in said end chamber are axially and radially spaced from one another sufficiently to prevent arcing.

2. A winding form as defined in claim 1, comprising two end chambers, each having a spiral land, the coil turns of each of said end chambers being positioned in a spiral configuration in the respective spiral land and having a radius that increases progressively toward the outer end thereof.

3. A winding form as defined in claim 1, wherein said partitions are of an annular shape.

4. A winding form as defined in claim 1, wherein said form is positioned surrounding said primary coil and said core.

5. A winding form as defined in claim 1, wherein said coil turns of said end chamber comprise from three to five turns.

* * * * *